United States Patent [19]

Yamazaki

[11] 4,113,135

[45] Sep. 12, 1978

[54] DRINKING CUP COVER

[76] Inventor: Takamitsu Yamazaki, 985 Shikawatashi, Yotsukaido-Machi, Chiba-ken, Japan

[21] Appl. No.: 803,587

[22] Filed: Jun. 6, 1977

[51] Int. Cl.[2] ..... B65D 41/32

[52] U.S. Cl. ..... 220/268; 229/7 R; 215/253; 220/90.4

[58] Field of Search ..... 229/7 R, 43; 222/494; 141/351, 326; 215/253; 220/90.2, 90.4; 128/122

[56] References Cited

U.S. PATENT DOCUMENTS

| | | | |
|---|---|---|---|
| 3,208,629 | 9/1965 | Beeson | 220/90.4 |
| 3,301,459 | 1/1967 | Gardner | 229/7 R X |
| 3,355,058 | 11/1967 | Asbury | 220/268 |
| 3,410,436 | 11/1968 | Foss et al. | 215/253 |
| 3,927,794 | 12/1975 | Erdman | 229/7 R X |
| 3,938,695 | 2/1976 | Ruff | 229/7 R X |
| 3,977,559 | 8/1976 | Lombardi | 229/7 R X |

*Primary Examiner*—Davis T. Moorhead

[57] ABSTRACT

A lid for a disposable drinking cup, and which includes a self-closing opening therethrough so that the lid can be retained upon the cup while drinking therefrom, the opening being closable by a flap that is pushed into an opened position by pressure from a person's lip whenever placed thereagainst.

4 Claims, 15 Drawing Figures

Fig. 1
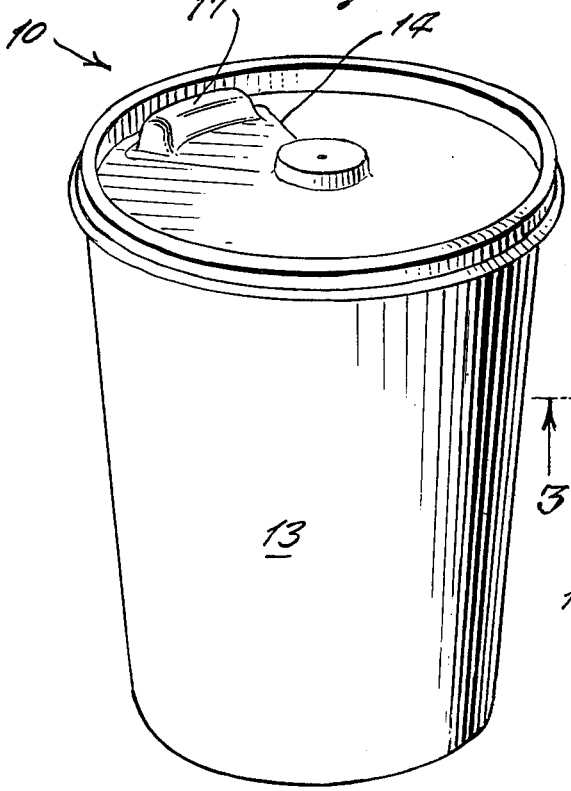
Fig. 2
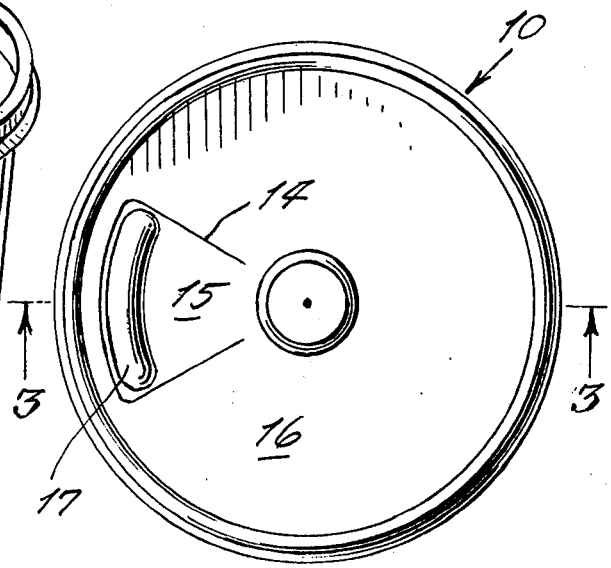
Fig. 3
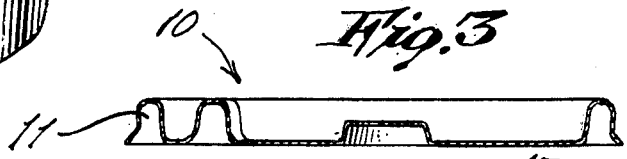
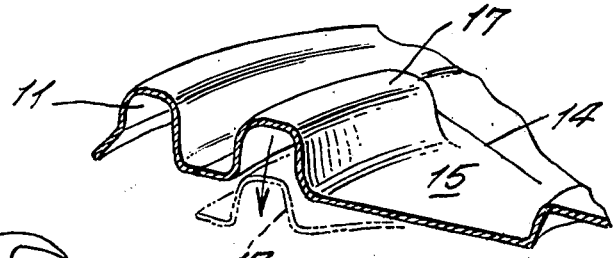
Fig. 4
Fig. 5
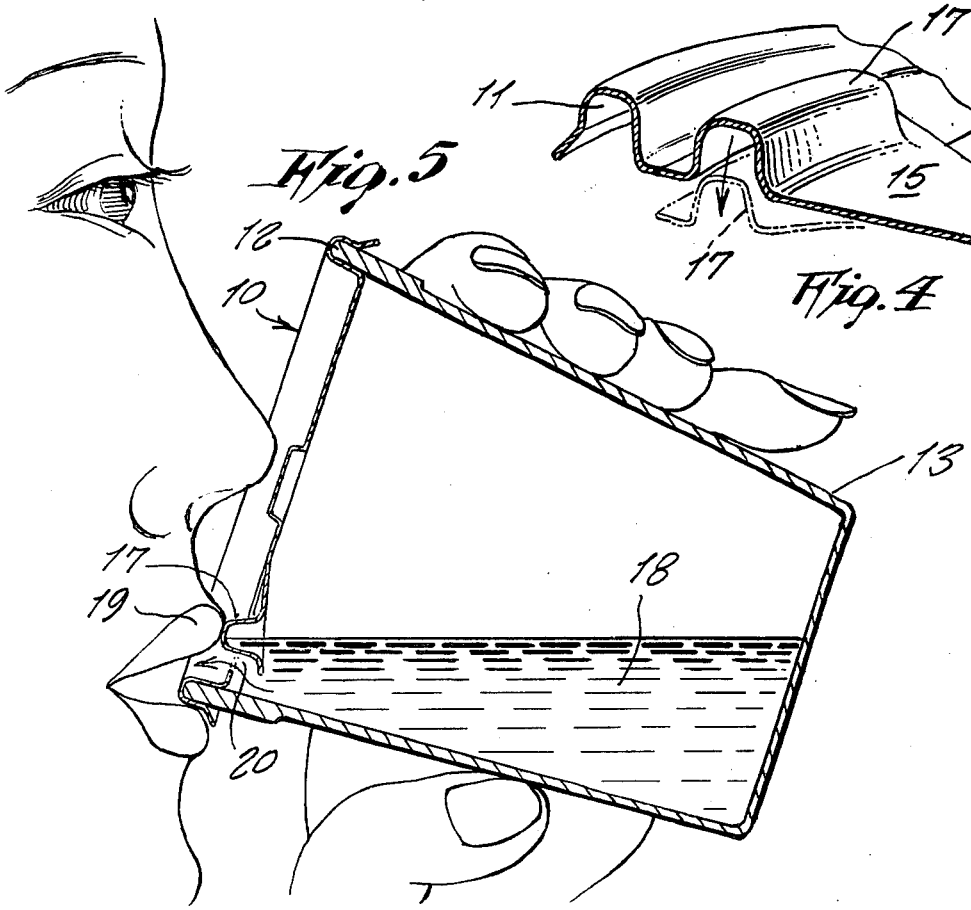

Fig. 6
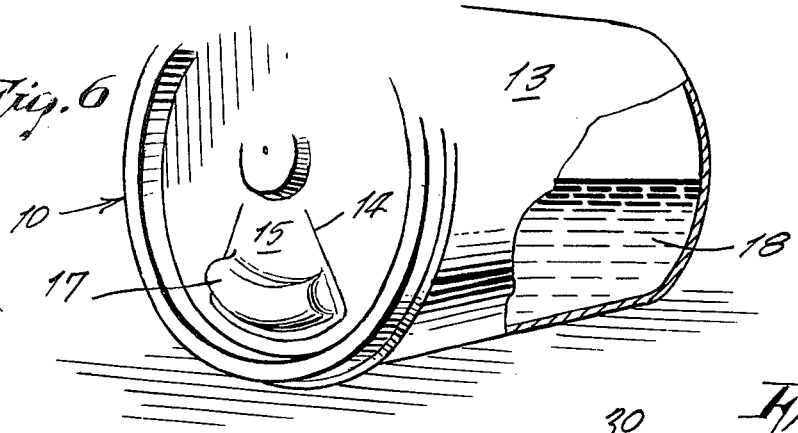
Fig. 7
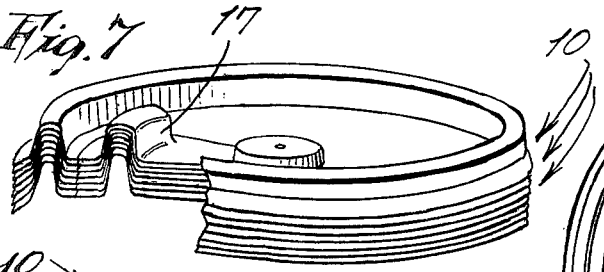
Fig. 8
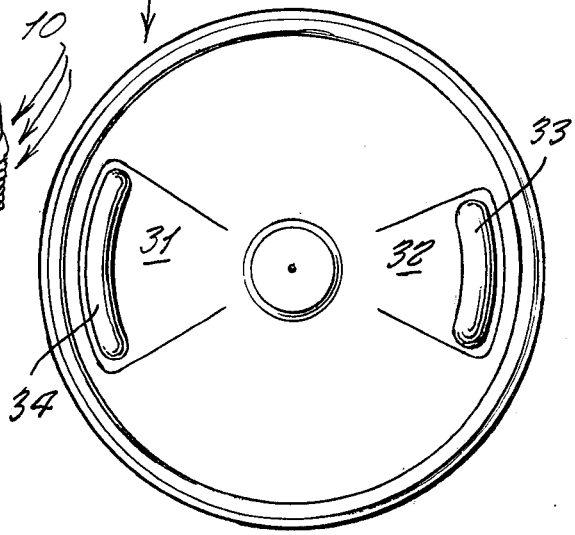
Fig. 9
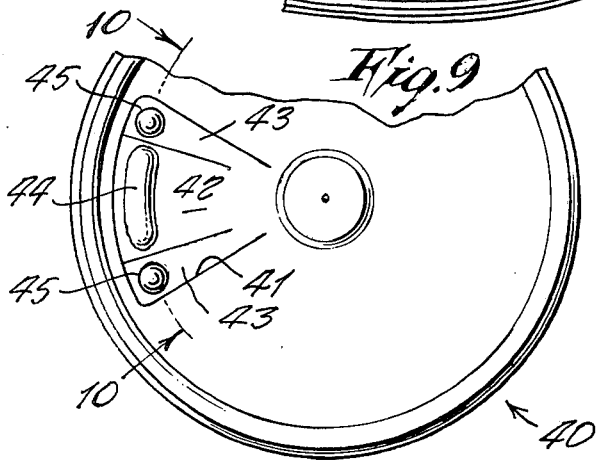
Fig. 10
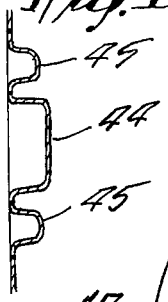
Fig. 11
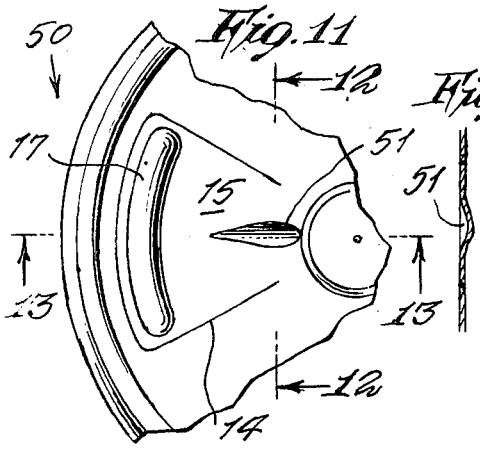
Fig. 12
Fig. 14
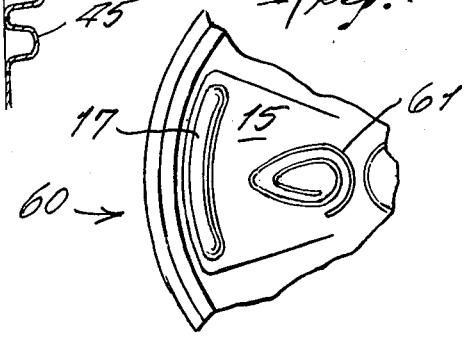
Fig. 13
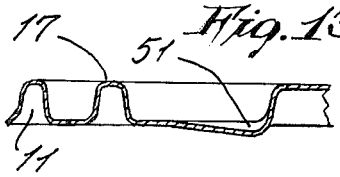
Fig. 15
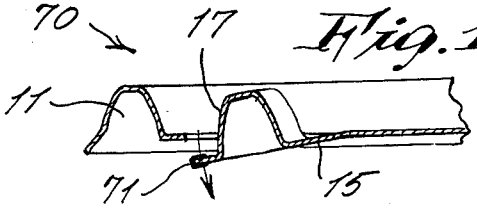

DRINKING CUP COVER

This invention relates generally to covers used for sealing disposable drinking cups.

It is generally well known to most persons that a conventional disposable drinking cup with its inwardly tapered lower end is easy to be accidentally knocked over when rested upon a supporting surface between sips of a beverage contained therein. This situation of spilling drinks is accordingly in want of an improvement.

In it is a principal object of the present invention to provide a cover for a drinking cup that can be retained thereupon while containing a beverage; the cover including a self-closing opening that opens up automatically when a person places the cup to his lips for drinking; and the opening remaining closed when away from a person's lips, so that if the cup is FIG. knocked over on a table between sips, the beverage will not spill out.

Another object is to provide a cover for a drinking cup that can be manufactured at no additional expense whatever over a conventional cover now being used, as it includes no additional parts nor additional steps in the manufacture of a conventional cover.

FIG. 1 is a perspective view of one design of the invention incorporated in a cover shown mounted on a disposable drinking cup.

FIG. 2 is a top view of the cover.

FIG. 3 is a cross-sectional view on line 3—3 of FIG. 2.

FIG. 4 is an enlarged fragmentary view thereof shown in perspective.

FIG. 5 is a view similar to FIG. 3 and showing the invention in operative use while a person is drinking from the cup.

FIG. 6 illustrates a knocked over cup with beverage not spilling out therefrom when the present invention is incorporated in the cover.

FIG. 7 illustrates a plurality of the covers tightly nested together without the present invention interfering therewith.

FIG. 8 is a top view of a modified design of cover in which a large and a separate small opening is provided so to serve either adults or small children.

FIG. 9 is a top view of another design thereof wherein a single opening is automatically adjustable to serve either adults or small children.

FIG. 10 is a cross-section on line 10—10 of FIG. 9.

FIG. 11 is a fragmentary top view of still another design of cover in which a strengthening bead is formed on the opening flap for insuring a tight re-seal thereof after each use.

FIG. 12 is a cross section on line 12—12 of FIG. 11.

FIG. 13 is a cross section on line 13—13 of FIG. 11.

FIG. 14 is a fragmentary top view of still another design of cover in which a strengthening bead spirals in oval shape.

FIG. 15 is a view generally similar to FIG. 4 and showing a modified design in which the flap edges are coated with an extra material so to insure a tight re-seal.

Referring now to the drawing in greater detail, and more particularly to FIGS. 1 through 7 thereof at this time, the reference numeral 10 represents a cover 10 according to the present invention which is a disc formed from a flat, thin sheet of plastic material. It includes an upwardly concaved groove 11 at its circular periphery for snap-fitting over an upper edge 12 of a conventional, disposable drinking cup 13 such as is made usually of plasticized paper or the like.

In the present invention, a generally U-shaped, die-cut slit 14 is made so to form a wedge-shaped tab 15 in the central area 16 that is surrounded by the groove. A raised rib 17 is formed along an edge of the free end of the tab. The rib tapers slightly upwardly so that, as shown in FIG. 7, when a plurality of the covers 10 are nested together, such as when packaged for shipment, the ribs fit inside one another.

It operative use of the invention, the cover 10 is snapped on a cup containing a beverage 18. A person desiring to drink the same directly from the cup, raises it to his mouth so that the cup edge 12 rests upon his lower lip in a conventional manner so that when the cup is tilted, the beverage will flow into the mouth. As shown in FIG, 5, when the cover is thus brought to the mouth, the person's upper lip 19 pushes against the rib, pushing the tab inwardly so to open up an opening 20 through which the beverage then flows. After a drink is taken and the cup is removed from the person's mouth, the tab automatically snaps back to close the opening 20. Thus, if the cup is rested between sips on a table and is accidentally knocked over, as shown in FIG. 6, none of the beverage spills out of the cup, due to the inherent springiness of the tab to return to its closed position. After use, the cover is discarded together with the cup.

In FIG. 8, a modified design of cover 30 has a large tab 31 and a small tab 32 on diametrically opposite sides of the cover so to selectively serve either adults or small children. The small tab thus forms a smaller opening for the children and results in less chance of dripping caused by excessive pouring. The rib 33 of tab 32 is taller than rib 34 of the tab 31 so a child's lip reaches it as readily as a prominent lip of an adult reaching the rib 34.

In FIG. 9, another design of cover 40 has a single opening 41 closable by a center tab 42 and a side tab 43 on each side edge thereof, so to serve either for adults or children. The center tab has a higher rib 44 while each side tab has a lower rib 45 as shown in FIG. 10, so that in use by a child, only the center tab is moved whereas when used by an adult, his larger and more prominent lip first moves the center tab and thereafter moves the side tabs so to cause a gradual beverage volume flow change, which is preferable against large volume surge. When the tabs are all closed, their edges are aligned with each other and the cover central area 16 seals the opening.

In FIG. 11, another design of cover 50 includes a shallow rib 51 extending transversely across the bending line between opposite ends of the slit 14 so to add rigidity for returning a tab back into a fully closed position in order to insure against a leak. As shown, the widest and deepest part of the rib bridges this bending line between the slit ends, so to be strongest, while an end of the rib extending upon the tab tapers gradually so to gradually be more flexible. Thus, the flexing of the tab is spread over a wide area instead of being confined only to the bending line between the slit ends. Thus, the re-sealing force of the tab does not wear out as quickly, so the tab fully seals the opening between drinking sips during the life of the cover.

In FIG. 14, a cover 60 has an oval-shaped spiral rib 61 of very shallow, even depth to accomplish the same purpose as the above described rib 51.

In FIG. 15, a cover 70 has an edge 71 of the tab coated with a soft plastic so to insure a tight sealing of the slit 14.

It is to be understood that the above described features can be variously combined, as preferred by a manufacturer.

I claim:

1. A disposable cover for a disposable drinking cup, comprising in combination, a circular disc formed of resilient think plastic, a circular groove on an underside of a periphery of said disc for snap-fitting on an upper edge of said cup, and a generally U-shaped slit on a central area framed by said groove forming a bendable tab, said tab having a hollow, raised rib along a free end edge thereof; said cover including a plurality of said tabs of different widths, a narrower width of said tabs having a higher said rib than a rib of the other.

2. A disposable cover for a disposable drinking cup, comprising in combination, a circular disc formed of resilient thin plastic, a circular groove on an underside of a periphery of disc for snap-fitting on an upper edge of said cup, and a generally U-shaped slit on a central area framed by said groove forming a bendable tab, said tab having a hollow, raised rib along a free end edge thereof; said tab being trifurcated into three tab members, each one of which has one said rib, a center of tab members being widest, and said rib thereof is less high than said rib of the other said tab members.

3. A disposable cover for a disposable drinking cup, comprising in combination, a circular disc formed of resilient thin plastic, a circular groove on an underside of a periphery of said disc for snap-fitting on an upper edge of said cup, and a generally U-shaped slit on a central area framed by said groove forming a bendable tab, said tab having a hollow, raised rib along a free end edge thereof; and a shallow rib extending transversely across a bending line between opposite ends of said slit.

4. The combination as set forth in claim 3, wherein said shallow rib has a widest and deepest portion thereof bridging said bending line while opposite ends of rib are gradually tapered to a point.

* * * * *